US005402210A

United States Patent [19]

Hart et al.

[11] Patent Number: 5,402,210

[45] Date of Patent: Mar. 28, 1995

[54] DYNAMIC DEVELOPER BIAS CONTROL FOR USE IN AN ELECTROSTATOGRAPHIC PRINTING MACHINE

[75] Inventors: Lawrence M. Hart, Ontario, N.Y.; Xu H. Feng; Ding Ya-Jun, both of Shanghai, China

[73] Assignee: Xerox Corporation, Stamford, Conn.

[21] Appl. No.: 139,687

[22] Filed: Oct. 22, 1993

[51] Int. Cl.[6] ..... G03G 21/00

[52] U.S. Cl. ..... 355/208; 355/246; 355/261

[58] Field of Search ..... 355/203, 204, 208, 210, 355/245, 261, 265, 326, 246

[56] References Cited

U.S. PATENT DOCUMENTS

| | | | |
|---|---|---|---|
| 4,213,693 | 7/1980 | Imai et al. | 355/265 |
| 4,304,486 | 12/1981 | Cormier et al. | 355/246 |
| 4,319,544 | 3/1982 | Weber | 118/647 |
| 4,372,674 | 2/1983 | Yukawa et al. | 355/14 |
| 4,669,859 | 6/1987 | Mochizuki et al. | 355/246 |
| 4,806,980 | 2/1989 | Jamzadeh et al. | 355/208 |
| 4,912,508 | 3/1990 | Zawadzki | 355/208 |
| 5,005,049 | 4/1991 | Matsushita | 355/208 |
| 5,266,997 | 11/1993 | Nakane et al. | 355/208 |

*Primary Examiner*—A. T. Grimley
*Assistant Examiner*—Sandra L. Brasé
*Attorney, Agent, or Firm*—Denis A. Robitaille

[57] ABSTRACT

A method and apparatus for providing a novel dynamic developer bias control system adapted to determine an optimal developer bias during the processing of the lead edge of an input document. Loss of image density for images on the lead edge of a document is minimized by varying the developer bias relative to variations in an optical sensor voltage signal. In addition, background development in the body of the copy sheet is further prevented by maintaining a developer bias at an elevated level in response to a determination that the lamp voltage exceeds a maximum level and the optical sensor signal is less than a predetermined target value.

18 Claims, 3 Drawing Sheets

DYNAMIC DEVELOPER BIAS CONTROL FOR USE IN AN ELECTROSTATOGRAPHIC PRINTING MACHINE

The present invention relates generally to electrostatographic printing machines, and more particularly, concerns a method and apparatus for preventing background development in electrostatographic printing applications.

Generally, the process of electrostatographic copying is initiated by exposing a light image of an original document to a substantially uniformly charged photoreceptive member. Exposing the charged photoreceptive member to a light image discharges the photoconductive surface thereof in areas corresponding to non-image areas in the original input document while maintaining the charge in image areas to create an electrostatic latent image of the original document on the photoconductive surface of the photoreceptive member. This latent image is subsequently developed into a visible image on the photoreceptive member by a process in which charged toner particles are deposited onto the photoconductive surface of the photoreceptor via an electrically biased developer electrode such that the toner particles are attracted to the charged image areas thereon. The toner particles are then transferred from the photoreceptive member to a copy sheet on which the image may be permanently affixed to provide a reproduction of the original document. In a final step, the photoreceptive member is cleaned to remove any residual developing material from the photoconductive surface in preparation for subsequent imaging cycles.

The described electrostatographic printing process is well known and is useful for light lens copying from an original input document, as well as for printing applications from electronically generated or stored originals. Analogous processes also exist in other electrostatographic applications such as, for example, ionographic applications, where charge is deposited on a charge retentive surface in accordance with an image stored in electronic form.

The process of developing a latent image on a photoreceptive member is carried out at a developer station, whereat toner particles are charged, transported from a developer housing to a vicinity adjacent the photoreceptive surface, and finally transferred to the latent image on the photoreceptive member. Various development methods have been described, as for example, in U.S. Pat. No. 3,618,552, cascade development; U.S. Pat. Nos. 2,874,063; 3,251,706; and 3,357,402, magnetic brush development; and U.S. Pat. No. 2,217,776, powder cloud development. While cascade and powder cloud development methods are especially well adapted for the development of lined images common to business documents, images which contain large solid areas are generally not faithfully reproduced by these methods. Whenever a latent image has large, solid image areas, a peculiar developing problem results wherein the development fields at the centers of the solid areas are weaker than at the edges of the solid areas. Accordingly, magnetic brush development systems are employed to increase the development at the centers of the solid areas.

However, to prevent development in the non-image areas of the non-image (background) areas of the electrostatic latent image, the electrostatic fields in these background regions have to be decreased. This is typically accomplished by applying a DC voltage to the developer roll for the purpose of suppressing the electrostatic development fields in the non-image areas. Raising and lowering this bias voltage is used to enhance copy quality whereby an increase in the bias voltage causes a decrease in the amount of toner that shifts to the non-image or low charge image areas on the photoreceptor and a decrease in the bias voltage permits toner particles to shift to the photoreceptor under a weaker electrostatic field. Thus, adjusting the developer bias can either eliminate the development of background areas, in the case of, for example, an original input document printed on colored paper, or can permit enhanced development, in the case of, for example, a light original input document wherein the charge on the photoreceptor may be too low to create a sufficient electrostatic latent image.

Thus, in the typical magnetic brush developing system, toner particles are flooded over the photoconductive surface while being confined between the photoconductive surface and a closely spaced electrode, wherein the closely spaced electrode has an electrical potential applied thereto. This electrical potential is known as developer bias, which generates a supplementary electric field for suppressing the electrical migration of the toner particles. Development in this manner is well known and is described in detail in U.S. Pat. No. 4,076,406 wherein a median bias value is predetermined to provide satisfactory development.

Original input documents that are being reproduced often vary considerably in terms of background image or color, resulting in different phototopic densities. For example, white documents may have absolute densities that range from 0.04 to 0.20 depending on factors such as quality and age. Other documents having colored or non-white backgrounds may have phototopic densities as high as 0.50. Despite the use of developer biasing, as described above, in the absence of compensating techniques, copiers or printers designed to reproduce large areas respond to the absolute level of input density and tend to produce unacceptable background imaging when copying non-white background documents. Various compensating techniques, known as background suppression or background stabilization, have been successfully implemented to reduce this undesirable result. For example, it is known to provide manual background stabilization in the form of a range of copy contrast settings on the control panel of a copier, whereby the high density background from a non-white original is suppressed by selecting a reduced contrast mode which typically increases exposure, increases developer bias, or performs a combination of the two. This technique has the disadvantage of being a hit-or-miss technique, causing considerable delays in the copying operation until the desirable compensation settings are found for the particular document.

Various approaches and solutions to the problems of background development are known in the prior art and have been disclosed. In particular, a thorough summary of diverse automatic background stabilization and suppression techniques is presented in U.S. Pat. No. 4,831,410, which is hereby incorporated by reference. In addition, it is noted that the model 5017 copier/-printer manufactured by Fuji Xerox incorporates an "Automatic Exposure Control" feature for controlling exposure lamp voltage to prevent background development in the body of a copy sheet. The present invention is directed toward dynamic control of the developer bias relative to photosensitivity and spectral sensitivity variations that can be found in photoreceptive members for compensating for such variations in photosensitivity and spectral sensitivity obtained during machine setup by automatically adjusting developer bias voltage values during the electrostatographic printing process. In this manner, the loss of image density for images on the lead edge of a document are minimized by adjusting the developer bias in response to an optical input sensor signal.

The following disclosures may be relevant to various aspects of the present invention:

U.S. Pat. No. 4,319,544 Patentee: Weber Issued: Mar. 16, 1982

U.S. Pat. No. 4,372,674 Patentee: Yukawa et al. Issued: Feb. 8, 1983

U.S. Pat. No. 4,912,508 Patentee: Zawadzki et al. Issued: Mar. 27, 1990

The relevant portions of the foregoing disclosures may be briefly summarized as follows:

U.S. Pat. No. 4,319,544 discloses a digitally synthesized dynamic bias method and apparatus for toning control in developing latent electrophotographic images wherein the instantaneous electric potential value of the bias is changed with time in proportion to the natural decay of the resident electric charge inherent in the photoconductor comprising the essence of the electrophotographic medium.

U.S. Pat. No. 4,372,674 discloses a copying machine having detectors for the background color and density of the original for facilitating creation of an improved quality reproduction of an original to be copied. The apparatus of that patent includes a first sensor for producing a signal in accordance with the density of the background of the original, a second sensor for producing a signal in accordance with the color of its background, and an electronic circuit for generating a bias voltage based on the sensed density and color of the background of the original for application to a developing apparatus.

U.S. Pat. No. 4,912,508 discloses an automatic background control for an electrostatic copier having a sensor in the optical path to sense the background of the document in the copy mode during the scanning of the document for adjusting the illumination of the document. The apparatus of that patent also includes a control to adjust the charging potential on the photoconductor in response to a non-white document background.

In accordance with the present invention, an electrostatographic printing apparatus for producing a copy of an original input document is provided, comprising: an imaging system for transmitting a light image of the original input document onto an imaging member to produce a latent image thereon, the imaging system including an optical sensor for sensing optical intensity of the transmitted light image; a developing system including a developer electrode for developing the latent image on the imaging member; means for applying an electrical bias to the developer electrode to generate electrical fields between the imaging member and the developer electrode; and means, coupled to the optical sensor and to the electrical bias applying means, for dynamically changing the electrical bias applied to the developer electrode in response to the sensed optical intensity of the transmitted light image.

In accordance with another aspect of the invention, an electrostatographic printing apparatus having an electrically biased developer electrode and including a dynamic developer bias control system is provided, comprising: means for determining a first average optical intensity for light reflected from a document having a first background color; means for determining a second average optical intensity for light reflected from a document having a second background color; means for determining an electrical bias required to be applied to the developer electrode to suppress background development of the document having the second background color; means for incrementally exposing an original input document to a light source for scanning the original input document; means for measuring instantaneous optical intensity for light reflected from the original input document; means for comparing the instantaneous optical intensity to the first average optical intensity; and means, responsive to the comparing means, for controlling the developer bias to a selected voltage.

In accordance with yet another aspect of the present invention, a method for dynamically controlling developer bias in an electrostatographic printing apparatus is disclosed, comprising the steps of: determining average optical intensity for a light signal reflected from a document having a first background color; determining average optical intensity for a light signal reflected from a document having a second background color; determining the developer bias required to suppress background development of the document having the second background color; incrementally exposing an original input document to a light source for scanning the original input document; measuring instantaneous optical intensity of a light signal reflected from the original input document during the scanning thereof; comparing the instantaneous optical intensity to the first average optical intensity for the light signal reflected from the document having the first background color; and setting the developer bias to a selected value in response to the comparing step.

These and other aspects of the present invention will become apparent from the following description in conjunction with the accompanying drawings in which.

While the present invention will be described in connection with a preferred embodiment thereof, it will be understood that it is not intended that the invention be limited to this preferred embodiment. On the contrary, the present invention is intended to cover all alternatives, modifications, and equivalents as may be included within the spirit and scope of the invention as defined by the appended claims.

Figure 4:
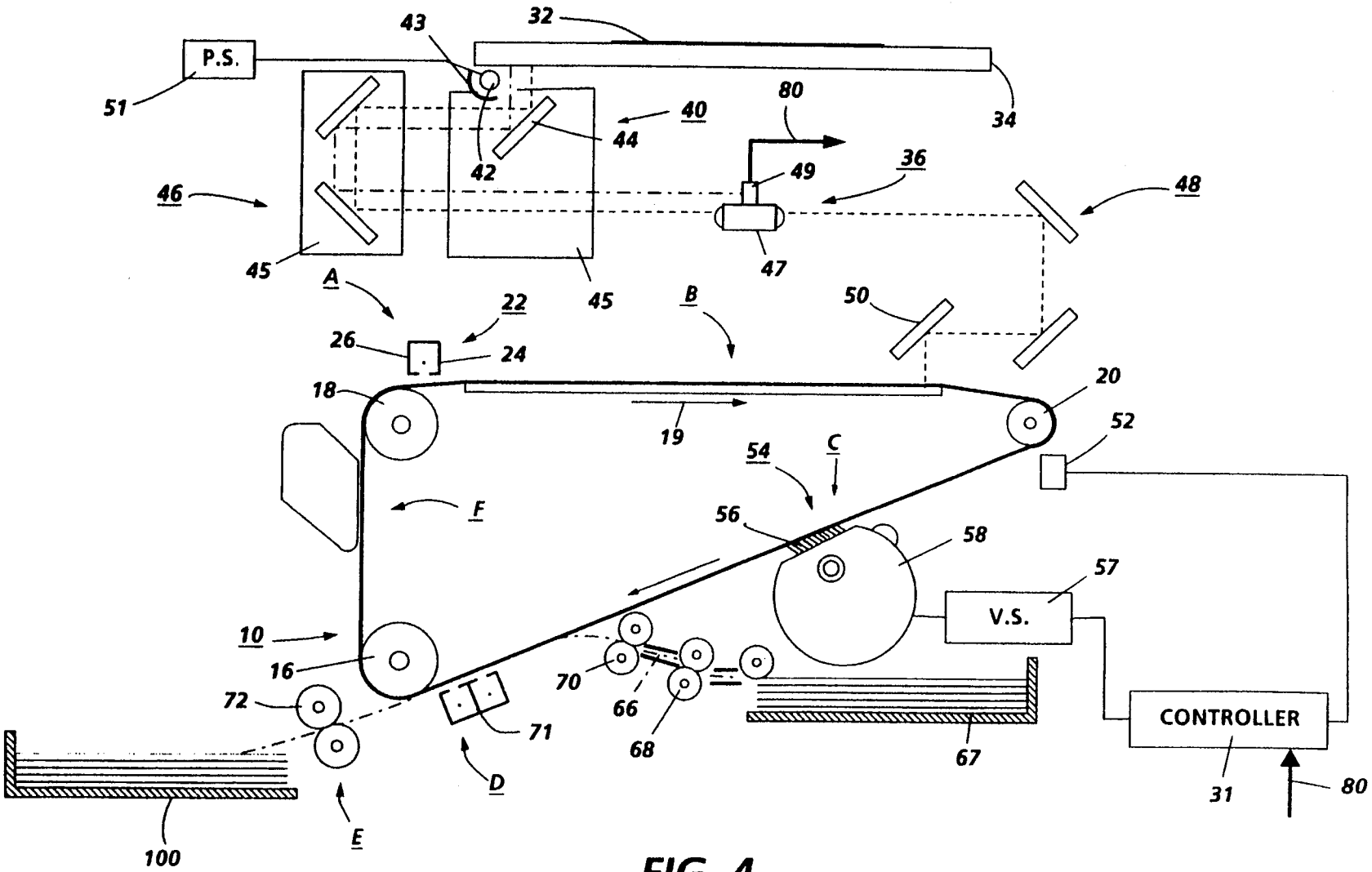
FIG. 4 is a schematic elevational view showing an electrophotographic copier employing the features of the present invention.

For a general understanding of the features of the present invention, reference is made to the drawings and the reference numerals contained therein for designating specific elements. Referring initially to FIG. 4, a schematic depiction of the various components of an exemplary electrophotographic reproducing apparatus incorporating the dynamic developer bias control system of the present invention is provided. Although the apparatus of the present invention is particularly well adapted for use in an automatic electrophotographic reproducing machine, it will become apparent from the following discussion that the present dynamic developer bias control system is equally well suited for use in a wide variety of electrostatographic processing machines and is not necessarily limited in its application to the particular embodiment or embodiments shown or described herein.

Inasmuch as the art of electrophotographic printing is well known, the various processing stations employed in the FIG. 4 printing machine will be shown schematically and their operation will be described briefly with reference thereto. The exemplary electrophotographic reproducing apparatus of FIG. 4 employs a belt 10 having a photoconductive surface layer deposited on an electrically grounded conductive substrate. A drive roller 16, coupled to a motor, not shown, engages with belt 10 to move the belt about a curvilinear path defined by the drive roller 16, and rotatably mounted tensioning rollers 18 and 20. This system of rollers is used for advancing successive portions of the photoconductive surface on belt 10 in the direction of arrow 19 through various processing stations disposed about the path of movement thereof, as will be described.

Initially, a portion of belt 10 passes through charging station A, where a corona generating device, generally indicated by reference numeral 22, or any other charging device charges photoconductive surface 12 to a relatively high, substantially uniform potential. Corona generating devices suited for this purpose are well known and generally comprise a charging electrode 24 partially surrounded by a conductive shield 26.

Once charged, the photoconductive surface of belt 10 is advanced to imaging station B where an original input document is exposed to a light source for forming a light image of the original input document. The light image is reflected and transmitted onto belt 10 to selectively dissipate the charge thereon, for recording an electrostatic latent image corresponding to the original document onto the photoconductive surface of belt 10. As can be seen in FIG. 4, an original document 32 is positioned, either manually or by a document feeder mechanism (not shown), on the surface of a transparent platen 34. Optics assembly 36 contains the optical components which incrementally illuminate and scan the document and project a reflected image onto the surface of belt 10. Shown schematically, these optical components comprise an illumination scan assembly 40, comprising illumination lamp 42, associated reflector 43 and full rate scan mirror 44, wherein all three components are mounted on a scan carriage, generally indicated by reference numeral 45. The scan carriage 45 is adapted to travel along a path parallel to and beneath the platen. Lamp 42 illuminates an incremental line portion of document 32 such that a light image thereof is reflected by scan mirror 44 to corner mirror assembly 46 mounted on a second scan carriage 45 moving at ½ the rate of mirror 44.

The light image of the original input document 32 is projected through lens 47 and reflected by a second corner mirror 48 to belt mirror 50. These mirrors 48, 50 both move at a predetermined relationship so as to transmit the projected image onto the surface of belt 10 while maintaining the required rear conjugate to form an electrostatic latent image corresponding to the informational areas contained within original document 32.

In accordance with the present invention, the level of illumination within the optical path between the original document 32 and the belt 10 can be measured in order to control the intensity of the exposure lamp 42 by increasing or decreasing the intensity thereof in response to the level of illumination sensed in the optical path. In the illustrated embodiment of FIG. 4, an optical sensor 49 is connected to a controller 31 and disposed near lens 47 in the optical path of the image projected from original document 32. An adjustable illumination power supply 51 is controlled by a portion of controller 31 for supplying selectively variable power to lamp 42. Although an optical system has been shown and described for forming the light image of the information used to selectively discharge the charged photoconductive surface, one skilled in the art will appreciate that a properly modulated scanning beam of energy (e.g., a laser beam) may be used to irradiate the charged portion of the photoconductive surface for recording the latent image thereon.

The belt then advances past a DC electrometer 52 positioned adjacent to the photoconductive surface of belt 10 between the exposure station B and development station C for generating a signal proportional to the dark development potential on the photoconductive surface. The dark development potential is the charge maintained on the photoconductor after charging and exposure. Preferably, the electrometer 52 is a nulling type device having a probe and head assembly (not shown) whereby the potential of the probe is raised to the potential of the surface being measured. The generated signal is transmitted to controller 31 through suitable conversion circuitry. The controller 31 may also be electrically connected to a high voltage power supply through suitable interface logic to control the bias voltage on the conductive shield 26 of the charging corotron in response to the generated signal from the electrometer 52 to adjust the charge applied to the photoconductive surface of belt 10. Further, in accordance with the present invention, the controller 31 is also coupled to the developer roller 56 for providing dynamic control of the developer bias, as will be described.

Next, the belt 10, having an electrostatic latent image recorded on the photoconductive surface thereof, advances to development station C where a magnetic brush development system, indicated generally by the reference numeral 54, advances developing material into contact with the electrostatic latent image on the surface of belt 10. Preferably, the magnetic brush development system 54 includes a developer roller 56 disposed in a developer housing 58 where toner particles are mixed with carrier beads, creating an electrostatic charge therebetween which causes the toner particles to cling to the carrier beads to form developing material. The developer roller 56 rotates and collects this developing material to produce a magnetic brush having developing material magnetically attached thereto. As the magnetic brush continues to rotate, the developing material is brought into contact with the photoconductive surface of belt 10 such that the electrostatic latent image thereon attracts the toner particles away from the carrier beads, forming a developed toner image on the photoconductive surface.

In a magnetic roll developing system as described hereinabove, a DC voltage source, as for example voltage source 57, is typically applied to the developer roller 56 for the purpose of creating an additional electrostatic field in the development zone adjacent to belt 10. This DC bias generally has a polarity opposite that of the toner for adjusting and enhancing copy quality. By increasing this bias voltage, the field between the developing material and the toner is increased such that a greater charge is needed on the photoconductive surface of belt 10 for attracting toner particles from the carrier beads, thereby decreasing the amount of toner that shifts to low charge areas on the photoconductive surface of the belt 10. Conversely, lowering the bias voltage applied to the developer roller 56 translates to a lower field strength required to shift toner particles from the carrier beads to the photoconductive surface of the belt 10. This variable developer bias can be provided by coupling voltage source 57 to controller 31 for adjusting the voltage applied to the developer roller 56 to provide optimum development of the electrostatic latent image, as will be discussed in further detail.

After the toner particles have been deposited onto the electrostatic latent image for development thereof, belt 10 advances the developed image to transfer station D, where an output copy sheet 66, taken from a supply tray 67, is moved into contact with the developed toner image via a pair of feed rollers 68 and 70. Transfer station D includes a corona generating device 71 which projects ions onto the back side of sheet 66, thereby attracting the toner image from the surface of belt 10 to sheet 66.

After transfer, the sheet is transported to fusing station E for permanently affixing the transferred image to the copy sheet 66. Fuser station E preferably comprises a heated fuser roller 72 positioned opposite a support roller, each roller being spaced relative to one another for receiving a sheet 66 therebetween. The toner image is thereby forced into contact with the copy sheet 66 to permanently affix the toner image to the copy sheet 66. After fusing, the copy sheet 66 to receiving tray 100 for subsequent removal of the finished copy by an operator.

Invariably, after the copy sheet 66 is separated from the photoconductive surface of belt 10, some residual developing material remains in contact with belt 10. Thus, a final processing station, namely cleaning station F, is provided for removing residual toner particles from the surface of belt 10 subsequent to separation of the copy sheet 66 therefrom. Cleaning station F can include a rotatably mounted fibrous brush (not shown) for physical engagement with the photoconductive surface of belt 10 for removing toner particles therefrom by rotation of the brush thereacross. Removed toner particles are stored in a cleaning housing chamber. Cleaning station F can also include a discharge lamp (not shown) for flooding the photoconductive surface with light in order to dissipate any residual electrostatic charge remaining thereon in preparation for a subsequent charging and imaging cycle.

The foregoing description should be sufficient for purposes of the present application for patent to illustrate the general operation of an electrophotographic reproducing apparatus incorporating the features of the present invention. As described, an electrophotographic reproducing apparatus may take the form of any of several well known devices or systems. Variations of specific electrostatographic processing subsystems or processes may be expected without affecting the operation of the present invention.

As described hereinabove, an optical sensor 49 is positioned in the optical path for monitoring incremental segments of a document 32 as it is scanned by the illumination scan assembly 40. The sensor 49 is therefore capable of monitoring the entire length of the platen 34 and any documents supported thereon. The sensor 49 provides a signal, indicated by reference numeral 80, to the controller 31, in response to a suitable timing signal therefrom, yielding an indication of the optical intensity at any preselected or designated location along the platen 34 such that the optical intensity along a document being scanned can be provided. Typically, as the optical sensor 49 detects the lead edge of the document 32 on the platen 34 a signal 80 is provided to the controller 31, which, in turn, adjusts the lamp voltage until the reflected light from the document reaches some predetermined target value. In one known system, initial adjustment of the lamp voltage occurs only in a lead edge area during, say the first 320 milliseconds of document processing (corresponding to approximately 7 mm of the input document). Thereafter, control of the lamp voltage is switched from control by the optical sensor 49 to a constant voltage control. In order to prevent background development on the lead edge of the copy sheet while the lamp voltage is being adjusted during lead edge processing, the bias voltage applied to the developer roll 56 from voltage supply 57 can be increased to a constant high voltage and later switched to a predetermined voltage at the point when control of the lamp voltage is switched to constant voltage control. The reason for setting the developer bias to a high voltage along the lead edge of the document is for preventing background development in the case of a dark background original input document. However, in a system as described, if such a dark background original input document has an image on the lead edge thereof, the resultant image density may be low or may be completely negated if the image on the lead edge is a low density image.

The present invention provides for dynamic control of the developer bias during scanning of the lead edge of an original input document so that loss of images on the lead edge of a dark background original input document can be minimized. This improvement is provided by causing the voltage source which generates the developer bias to be responsive to the optical sensor signal during the lead edge processing of the original input document 32. Referring now more particularly to the specific subject matter of the present invention, a method is described for determining photosensitivity of a photoreceptor as it relates to the voltage signal output from optical sensor 49 and the resultant developer bias voltage required to suppress background development. With specific reference to FIG. 1, there is shown a flow chart describing a series of successive steps for providing dynamic developer bias control in an electrostatographic printing machine by determining the optimal developer bias voltage required to suppress background development.

Figure 1:
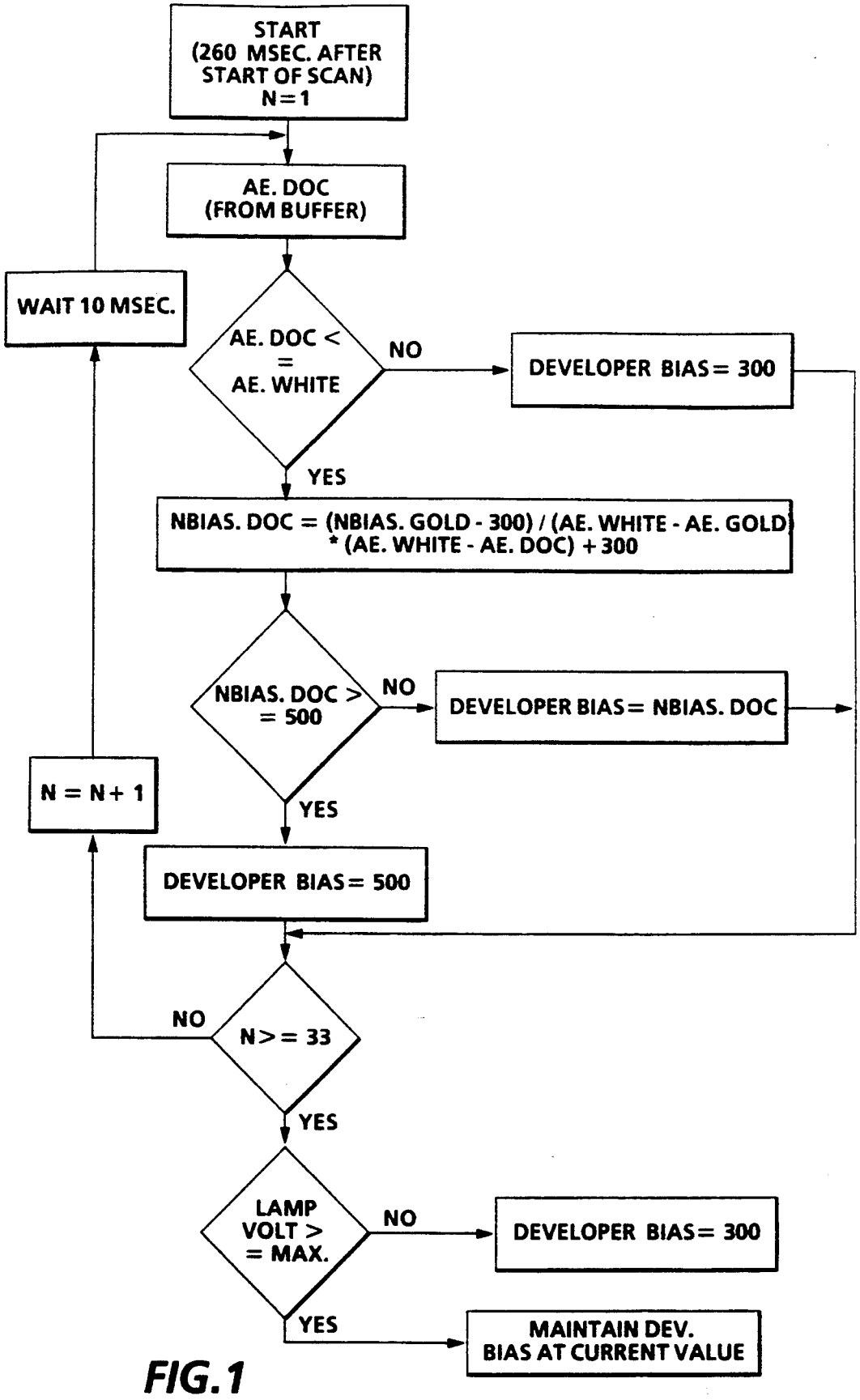
FIG. 1 is a flowchart depicting a sequence of operating steps for dynamic developer bias control as provided by the present invention.
Figure 2:
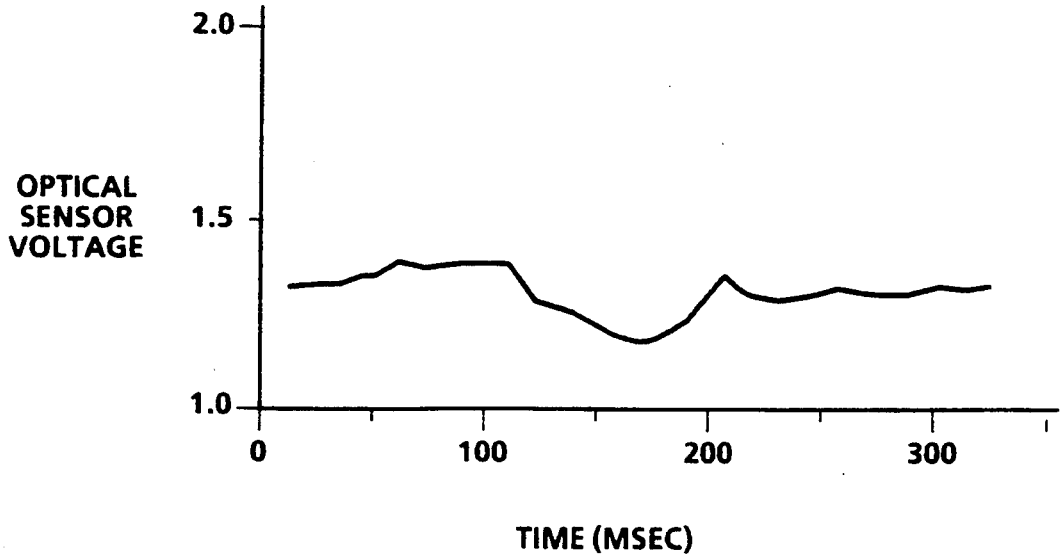
FIG. 2 is a graphic representation of a voltage signal from an optical sensor with respect to time during the processing of the lead edge of a copy sheet.
Figure 3:
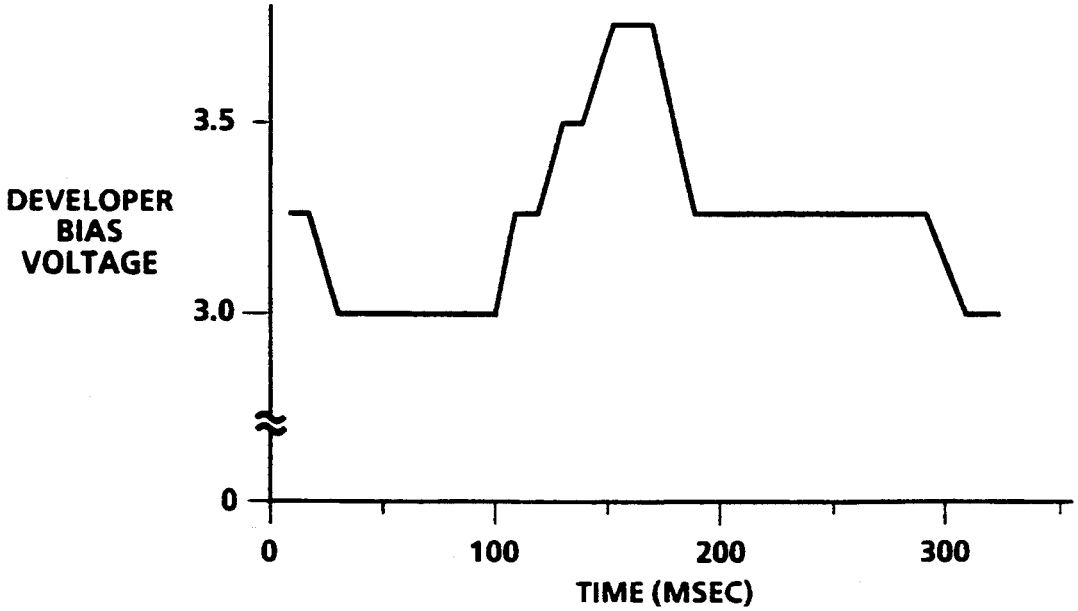
FIG. 3 is a graphic representation of the developer bias voltage signal with respect to time during the processing of a lead edge of a copy sheet.

The sequence of operations illustrated in the flow chart of FIG. 1 is directed toward determining a set of variables which are stored in nonvolatile memory (NVM) of controller 31 and used for calculating and setting the developer bias during the processing of the lead edge of an original input document. The following variables are determined at machine setup or when a new photoreceptor is installed by monitoring the optical sensor and the developer bias, respectively: the average optical sensor voltage signal while scanning a white document (or when monitoring a white reference strip which may, for example, be embedded into the platen cover), identified by the variable name AE.-WHITE; the average optical sensor voltage signal while scanning a dark document, in this case a "goldenrod" colored document which represents a typical a stress condition, identified by the variable name AE.-GOLD; and the developer bias level required to suppress background development on a copy sheet produced from a "goldenrod" input document, identified by the variable name NBIAS.GOLD.

After the preceding variables have been defined, the procedure of the present invention can be utilized to provide dynamic developer bias control during the electrostatographic process. It will be noted from the flow chart of FIG. 1 that a delay of 260 milliseconds is introduced at the start of the process. This delay represents a time delay that exists between the time that the photoconductive surface of the belt 10 is first exposed and the time that the exposed area on the belt 10 reaches the development zone. The variable identified by the variable name AE.DOC is the optical sensor 49 voltage signal measured as the lamp carriage scans the original input document and is therefore equivalent to the instantaneous optical intensity of light reflected from an input document to be printed. In the particular embodiment described herein, the optical sensor 49 voltage signal is monitored every 10 milliseconds as the lamp carriage scans the input document and the value of AE.DOC at each 10 millisecond interval is stored in a buffer and subsequently removed in 10 millisecond intervals 260 milliseconds after the lamp carriage 45 starts the scan of the input document 32. It will be understood by those of skill in the art that an averaging routine could be implemented into the algorithm of the present invention so that an average of a certain number of values stored in the buffer could be used as opposed to each individual input value. Such averaging may allow for the use of hardware having slower response times or might be advantageous for use in preventing noise spikes or the like from effecting the desired output.

After a 260 millisecond delay from the beginning of the scan of the input document, a counter is set to 1. Next, the optical sensor voltage signal (AE.DOC), representing the optical intensity of the signal in the optical path is retrieved from the buffer and it is determined whether this optical sensor signal voltage is less than or equal to the average optical sensor voltage for a scanned white document (AE.WHITE). If the optical sensor voltage signal (AE.DOC) is greater than the average optical sensor voltage for a scanned white document (AE.WHITE), the developer bias is set to a default voltage of 300 volts. The counter is then updated and a new optical voltage sensor signal is retrieved from the buffer after 10 milliseconds. However, if the optical sensor voltage signal (AE.DOC) is less than or equal to the average optical sensor voltage for a scanned white document (AE.WHITE) the developer bias, identified by the variable name NBIAS.DOC, is set to the quantity value of the product of the difference between the developer bias level required to suppress background development on a dark input document (NBIAS.-GOLD) and 300 volts divided by the difference between the average optical sensor voltage while scanning a white document (AE.WHITE) and the average optical sensor voltage while scanning a dark document (AE.GOLD) and the difference between the average optical sensor voltage while scanning a white document (AE.WHITE) and the particular instantaneous optical sensor voltage signal (AE.DOC) plus 300 volts. By setting the developer bias to this value, the developer bias is forced to track the optical sensor signal. The calculated developer bias may be more clearly understood by the following equation:

$$\text{NBIAS.DOC} = \frac{(\text{NBIAS.GOLD} - 300)}{(\text{AE.WHITE} - \text{AE.GOLD})} \times (\text{AE.WHITE} - \text{AE.DOC}) + 300$$

It will be noted from FIG. 1 that, if the value of the calculated developer bias (NBIAS.DOC) as defined by the above equation is greater than or equal to a predetermined value, in this case 500 volts, then the developer bias is set to this value of 500 volts as a default maximum developer bias voltage. After this developer bias is set, the counter is once again incremented and an updated value of the optical sensor voltage signal is retrieved from the buffer after a 10 millisecond interval. Thus, a new developer bias voltage is calculated in 10 millisecond intervals until the counter reaches 33, equivalent to the first 320 milliseconds of the input document scanning process.

Subsequent to this initial 320 millisecond interval representing the scanning of the lead edge of the document 32, the lamp voltage is also monitored by controller 31 to determine whether the voltage applied to the lamp is greater than or equal to a predetermined maximum voltage as determined by lamp life considerations. If the lamp voltage does not exceed this predetermined maximum voltage, the developer bias (NBIAS.DOC) is set to 300 volts. However, if the lamp voltage does exceed the maximum predetermined lamp voltage, the developer bias (NBIAS.DOC) is maintained at the value determined by the last iteration of the developer bias control loop. In this step, the developer bias is artificially elevated to a predetermined default voltage for preventing background development under the condition where lamp voltage reaches a maximum level while exposure of the original input document is insufficient.

In recapitulation, it should now be clear from the foregoing discussion that the method and apparatus of the present invention provides a novel dynamic developer bias control system adapted to determine an optimal developer bias during the processing of the lead edge of an input document. Both background development and the loss of image density for images on the lead edge of a document is minimized by varying the developer bias relative to the variation in optical intensity of the original input document signal. In addition, background development in the body of the copy sheet is further prevented by maintaining a developer bias at an elevated level in response to a determination that the lamp voltage exceeds a maximum level and the optical sensor voltage is less than a predetermined target value.

It is, therefore, apparent that there has been provided, in accordance with the present invention, a dynamic developer bias control system that fully satisfies the aims and advantages set forth hereinabove. While this invention has been described in conjunction with a specific embodiment thereof, it will be evident to those skilled in the art that many alternatives, modifications, and variations are possible to achieve the desired results. Accordingly, the present invention is intended to embrace all such alternatives, modifications, and variations which may fall within the spirit and scope of the following claims.

We claim:

1. An electrostatographic printing apparatus for producing a copy of an original input document, comprising:

an imaging system for transmitting a light image of the original input document onto an imaging member to produce a latent image thereon, said imaging system including an optical sensor for sensing optical intensity of the transmitted light in a lead edge area of the original input document corresponding to a non image area of the original input document;

a developing system including a developer electrode for developing said latent image on said imaging member;

means for applying an electrical bias to said developer electrode to generate electric fields between said imaging member and said developer electrode; and means, coupled to said optical sensor and to said electrical bias applying means, for dynamically changing the electrical bias applied to said developer electrode in response to said sensed optical intensity of the lead edge area transmitted light.

2. The electrostatographic printing apparatus of claim 1, wherein said changing means includes control means coupled to said imaging system and said developing system.

3. An electrostatographic printing apparatus having an electrically biased developer electrode and including a dynamic developer bias control system for providing selected electrical bias during processing of a lead edge of an original input document, comprising:

means for determining a first average optical intensity for light reflected from a document having a first background color;

means for determining a second average optical intensity for light reflected from a document having a second background color;

means for determining an electrical bias required to be applied to said developer electrode to suppress background development of the document having the second background color;

means for incrementally exposing an original input document to a light source for scanning the original input document;

means for measuring instantaneous optical intensity for light reflected from said original input document;

means for comparing said instantaneous optical intensity to said first average optical intensity; and means, responsive to said comparing means, for controlling the developer bias to a selected voltage during processing of a lead edge area of the original input document.

4. The electrostatographic printing apparatus of claim 3, wherein said comparing means includes means for evaluating whether said instantaneous optical intensity is less than, equal to or greater than said first average optical intensity.

5. An electrostatographic printing apparatus having an electrically biased developer electrode and including a dynamic developer bias control system, comprising:

means for determining a first average optical intensity for light reflected from a document having a first background color;

means for determining a second average optical intensity for light reflected from a document having a second background color;

means for determining an electrical bias required to be applied to said developer electrode to suppress background development of the document having the second background color;

means for incrementally exposing an original input document to a light source for scanning said original input document;

means for measuring instantaneous optical intensity for light reflected from said original input document;

means for comparing said instantaneous optical intensity to said first average optical intensity; and means, responsive to said comparing means, for controlling the developer bias to a selected voltage, wherein said controlling means includes means, operative in response to a determination that said instantaneous optical intensity is less than or equal to said first average optical intensity, for setting said developer bias in accordance with the following equation:

$$\text{NBIAS.DOC} = \frac{(\text{NBIAS.GOLD} - 300)}{(\text{AE.WHITE} - \text{AE.GOLD})} \times (\text{AE.WHITE} - \text{AE.DOC}) + 300$$

where:

NBIAS.DOC represents said selected voltage for biasing said developer electrode;

NBIAS.GOLD represents the electrical bias required to be applied to said developer electrode to suppress background development of the input document having the second background color;

AE.WHITE represents said first average optical intensity;

AE.GOLD represents said second average optical intensity; and

AE.DOC represents said instantaneous optical intensity for light reflected from an original input document to be printed.

6. The electrostatographic printing apparatus of claim 5, wherein said controlling means includes means, operative in response to a determination that said instantaneous optical intensity is greater than said first average optical intensity, for setting said developer bias to a first predetermined default voltage.

7. The electrostatographic printing apparatus of claim 6, wherein said first predetermined default voltage is approximately 300 volts.

8. The electrostatographic printing apparatus of claim 6, further including:

means for measuring voltage across said light source;

means for evaluating whether said voltage across said light source is less than a predetermined maximum light source voltage; and means, operative in response to a determination that the voltage across said light source is greater than or equal to said predetermined maximum light source voltage, for setting said developer bias to said first predetermined default value.

9. The electrostatographic printing apparatus of claim 5, wherein said controlling means includes means, operative in response to a determination that said selected voltage for biasing said developer electrode is greater than a second predetermined default voltage, for setting said developer bias to said second predetermined default voltage.

10. The electrostatographic printing apparatus of claim 9, wherein said second predetermined default voltage is approximately 500 volts.

11. A method for dynamically controlling developer bias in an electrostatographic printing apparatus for providing selected electrical bias during processing of an original input document, comprising the steps of:

determining a first average optical intensity for a light signal reflected from a document having a first background color;

determining a second average optical intensity for a light signal reflected from a document having a second background color;

determining the developer bias required to suppress background development of the document having the second background color;

incrementally exposing an original input document to a light source for scanning said original input document;

measuring instantaneous optical intensity of a light signal reflected from the original input document during said scanning thereof;

comparing said instantaneous optical intensity to said first average optical intensity; and setting the developer bias to a selected value during processing of the lead edge area of said original input document in response to said comparing step.

12. The method of claim 11, wherein said comparing step includes evaluating whether said instantaneous optical intensity is less than, equal to or greater than said first average optical intensity.

13. A method for dynamically controlling developer bias in an electrostatographic printing apparatus, comprising the steps of:

determining average optical intensity for a light signal reflected from a document having a first background color;

determining average optical intensity for a light signal reflected from a document having a second background color;

determining the developer bias required to suppress background development of the document having the second background color;

incrementally exposing an original input document to a light source for scanning said original input document;

measuring instantaneous optical intensity of a light signal reflected from the original input document during said scanning thereof;

comparing said instantaneous optical intensity to said first average optical intensity; and setting the developer bias to a selected value in response to said comparing step, wherein said setting step includes the step of determining the selected value in accordance with the following equation if said comparing step results in a determination that said instantaneous optical intensity is less than or equal to said average optical intensity for the light signal reflected from the document having the first background color:

$$\text{NBIAS.DOC} = \frac{(\text{NBIAS.GOLD} - 300)}{(\text{AE.WHITE} - \text{AE.GOLD})} \times (\text{AE.WHITE} - \text{AE.DOC}) + 300$$

where:

NBIAS.DOC represents said selected value for biasing said developer electrode;

NBIAS.GOLD represents the developer bias required to suppress background development of the document having the second background color;

AE.WHITE represents the average optical intensity for light reflected from the document having the first background color;

AE.GOLD represents the average optical intensity for light reflected from the input document having the second background color; and AE.DOC represents said instantaneous optical intensity for light reflected from the original input document.

14. The method of claim 13, wherein said developer bias determining step comprises the step of setting the developer bias to a first predetermined default value in response to said evaluating step resulting in a determination that said instantaneous optical intensity is greater than said average optical intensity for the light signal reflected from the document having the first background color.

15. The method of claim 14, wherein said developer bias setting step comprises the step of establishing said first predetermined default value to approximately 300 volts.

16. The method of claim 13, further including a steps of:

evaluating whether said selected value is greater than a second predetermined default value; and setting said developer bias to said second predetermined default value in response to said evaluating step resulting in a determination that said selected value is greater than said second predetermined default value.

17. The method of claim 16, wherein said developer bias setting step comprises the step of establishing said second predetermined default value to approximately 500 volts.

18. The method of claim 11, further including a steps of:

measuring voltage across said light source;

evaluating whether said voltage across said light source is less than a predetermined maximum light source voltage; and setting said developer bias to said first predetermined default value in response to said evaluating step resulting in a determination that the voltage across said light source is greater than or equal to said predetermined maximum light source voltage.

* * * * *